US010049828B2

(12) United States Patent
Liao et al.

(10) Patent No.: US 10,049,828 B2
(45) **Date of Patent: *Aug. 14, 2018**

(54) KEY SWITCH WITH NOISE REDUCTION MECHANISM

(71) Applicant: Darfon Electronics Corp., Taoyuan (TW)

(72) Inventors: Pen-Hui Liao, Taoyuan (TW); Liang-Ta Yeh, New Taipei (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/796,473

(22) Filed: Oct. 27, 2017

(65) Prior Publication Data

US 2018/0053606 A1 Feb. 22, 2018

Related U.S. Application Data

(63) Continuation of application No. 15/049,153, filed on Feb. 22, 2016, now Pat. No. 9,837,221.

(51) Int. Cl.
*H01H 13/70* (2006.01)
*H01H 3/12* (2006.01)
*H01H 13/705* (2006.01)

(52) U.S. Cl.
CPC ..... *H01H 3/125* (2013.01); *H01H 13/705* (2013.01); *H01H 2209/046* (2013.01); *H01H 2221/062* (2013.01)

(58) Field of Classification Search
CPC ..... H01H 2209/046; H01H 2209/068; H01H 2209/074; H01H 2215/008; H01H 2221/002; H01H 2221/004; H01H 2221/062; H01H 2223/003; H01H 13/10; H01H 13/20; H01H 13/702; H01H 13/704; H01H 13/705; H01H 3/25; H01H 71/025; H01H 71/1018; H01H 71/24
USPC ..... 200/510, 511, 512, 520, 5 A, 269, 341
See application file for complete search history.

(56) References Cited

U.S. PATENT DOCUMENTS 9,373,454 B2 * 6/2016 Takemae ..... H01H 3/125
9,837,221 B2 * 12/2017 Liao ..... H01H 3/125

* cited by examiner

*Primary Examiner* — Anthony R. Jimenez
(74) *Attorney, Agent, or Firm* — Winston Hsu

(57) ABSTRACT

A key switch includes a baseplate, a circuit layer, a keycap and a support rod. The baseplate has a hook and a first through hole neighboring to the hook. The circuit layer includes a first sublayer disposed above the baseplate and having a second through hole, and a second sublayer disposed above the first sublayer and having a third through hole; a portion of the second sublayer extends over the second through hole and forms a first resilient portion; the first resilient portion has four sides, two of which connect to the second sublayer; and the first resilient portion is neighboring to the hook. The keycap is disposed above the baseplate and can move upward and downward in respect to the baseplate. The support rod has a first portion and a second portion; the first portion movably connects to the keycap and the second portion engages the hook.

20 Claims, 16 Drawing Sheets

400

500

KEY SWITCH WITH NOISE REDUCTION MECHANISM

CROSS-REFERENCE TO RELATED APPLICATION

This application is a continuation of an application Ser. No. 15/049,153, filed on Feb. 22, 2016. The entirety of each of the above-mentioned patent applications is hereby incorporated by reference herein and made a part of this specification.

FIELD OF THE INVENTION

The present invention relates to a key switch, and more particularly to a key switch with noise reduction mechanism.

BACKGROUND OF THE INVENTION

Keyboard is an input device for inputting words, characters, and numbers and has been indispensible to the operations of personal computers, consumer electronics, and industrial process equipments.

On a typical keyboard, most of the keys have standard size square keycaps, while other keys, such as the Space bar, Enter key, Caps Lock key, and Shift key, have enlarged keycaps.

For those keys with enlarged keycaps, support rods are adopted to enhance the structural strength of keycaps so that the enlarged keycaps would not tilt when the user presses the keys at positions other than the center of the keys. However, as support rods are usually designed to be in direct contact with the baseplate and the area of contact between the two components is relatively large, upward and downward movements of keycaps typically cause undesirable noises resulting from collision between the support rod and the baseplate. Consequently, there is a need for a key switch with reduced typing noise and good structural strength sufficient for use on keyboards for frequently operated consumer electronics.

BRIEF SUMMARY OF THE INVENTION

The present invention provides a key switch to achieve volume reduction of noises produced during key pressing.

An embodiment of the present invention provides a key switch, which includes a baseplate, a circuit layer, a keycap, and a support rod. The baseplate has a hook and a first through hole neighboring to the hook. The circuit layer includes a first sublayer and a second sublayer. The first sublayer is disposed above the baseplate and has a second through hole. The second sublayer is disposed above the first sublayer and has a third through hole; a portion of the second sublayer extends over the second through hole and forms a first resilient portion. The first resilient portion has at least four sides, with at least two sides of the four sides connecting to the second sublayer; and the first resilient portion is neighboring to the hook. The keycap is disposed above the baseplate and can move upward and downward in respect to the baseplate. The support rod has a first portion and a second portion; the first portion movably connects to the keycap, and the second portion engages the hook so that a lower end of the second portion passes through the third through hole and the second through hole and reaches the first through hole; meanwhile, the first resilient portion extends beneath and abuts against the second portion the first resilient portion so that the first resilient portion buffers the collision between the second portion and the baseplate when the keycap moves upward and downward in respect to the baseplate.

Another embodiment of the present invention provides a key switch, which includes a baseplate, a circuit layer, a film, a keycap, and a support rod. The baseplate has a hook and a first through hole neighboring to the hook. The circuit layer is disposed above the baseplate and has a second through hole. The film is disposed above the circuit layer and has a third through hole; a portion of the film extends over the second through hole and forms a first resilient portion; the first resilient portion has at least four sides, with at least two sides of the four sides connecting to the film and at least two other sides of the four sides separating from the film; the first resilient portion is neighboring to the hook. The keycap is disposed above the baseplate and can move upward and downward in respect to the baseplate. The support rod has a first portion and a second portion; the first portion movably connects to the keycap, and the second portion engages the hook so that a lower end of the second portion passes through the third through hole and the second through hole and reaches the first through hole; the first resilient portion extends beneath and abuts against the second portion so that the first resilient portion buffers the collision between the second portion and the baseplate when the keycap moves upward and downward in respect to the baseplate.

Yet another embodiment of the present invention provides a key switch, which includes a baseplate, a circuit layer, a keycap, and a support rod. The baseplate has a hook and a first through hole neighboring to the hook. The circuit layer is disposed above the baseplate and has a first sublayer, a second sublayer, and a third sublayer. The first sublayer is disposed above the baseplate and has a second through hole and a lower electrode. The second sublayer is disposed above the first sublayer and has a third through hole and an upper electrode; a portion of the second sublayer extends over the second through hole and forms a first resilient portion; the first resilient portion has at least four sides, with at least two sides of the four sides connecting to the second sublayer. The third sublayer is disposed between the first sublayer and the second sublayer and has a fourth through hole. The keycap is disposed above the baseplate and can move upward and downward in respect to the baseplate; the upper electrode and the lower electrode are separated by the second sublayer and are electrically connected when the keycap moves downward. The support rod has a first portion and a second portion; the first portion movably connects to the keycap, and the second portion engages the hook; the first resilient portion extends beneath and abuts against the second portion so that the first resilient portion buffers the collision between the lower surface of the second portion and the baseplate when the keycap moves upward and downward in respect to the baseplate.

The key switch according to the embodiments of the present invention achieves volume reduction of noise produced during key pressing by utilizing a resilient portion to support the second portion of the support rod so as to buffer the collision between the baseplate and the second portion of the support rod when the keycap moves upward and downward in respect to the baseplate.

For making the above and other purposes, features and benefits become more readily apparent to those ordinarily skilled in the art, the preferred embodiments and the detailed descriptions with accompanying drawings will be put forward in the following descriptions.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF THE INVENTION

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
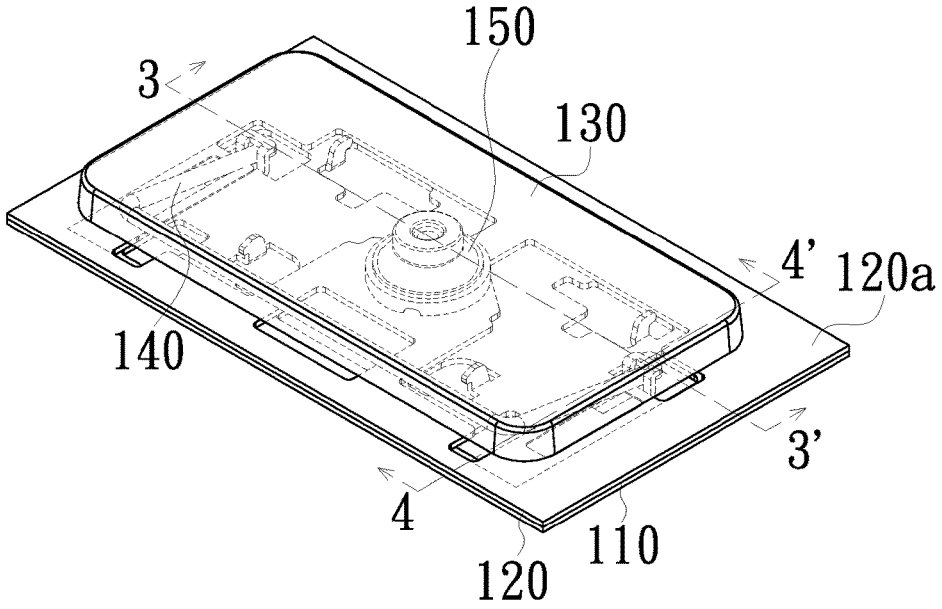
FIG. 1 is a schematic three-dimensional view of a key switch according to an embodiment of the present invention.
Figure 2:
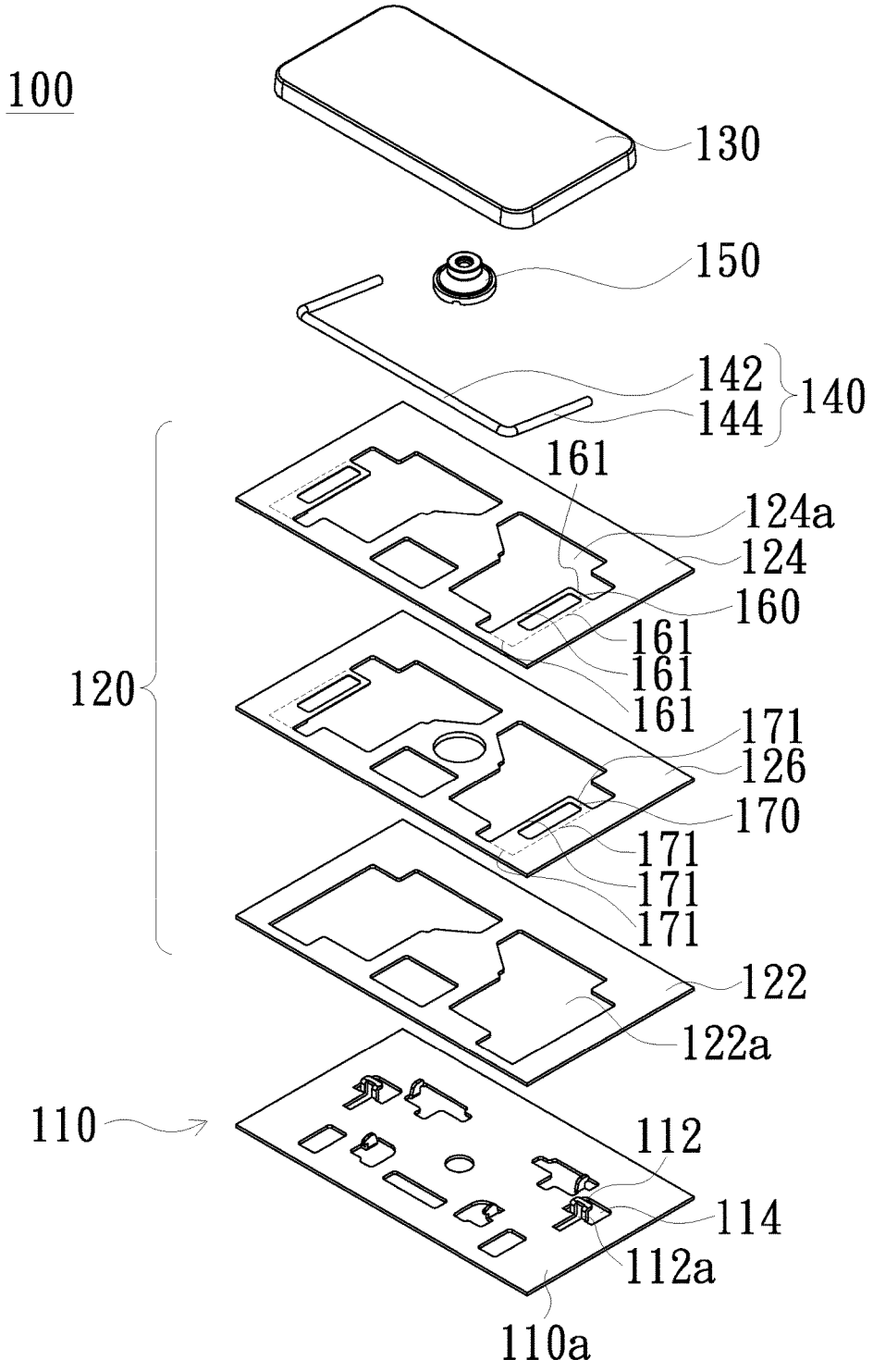
FIG. 2 is a schematic exploded view of the key switch of FIG. 1.

Referring now to FIG. 1 and FIG. 2, which illustrate a three-dimensional view and an exploded view of a key switch according to an embodiment of the present invention.

The key switch 100 of the present embodiment may include a baseplate 110, a circuit layer 120, a keycap 130, and a support rod 140. The baseplate 100 has two pairs of opposite sides, two opposing hooks 112, and two first through holes 114. Each of the hooks 112 stands on the top surface 110*a* of the baseplate 110 and is neighboring to a corresponding first through hole 114. The baseplate 110 may be, but is not limited to, a metallic baseplate.

The keycap 130 is disposed above the baseplate 110 and can move upward and downward in respect to the baseplate 110. The support rod 140 has a first portion 142 and two second portions 144 connecting to the two opposite ends of the first portion 142; in other words, the second portions 144 may be formed by bending and extending the two opposite ends of the first portion 142 toward the same direction. Meanwhile, the first portion 142 is movably connected to the keycap 130; that is, the first portion 142 may attach to the keycap 130 and pivot about the attached position. For example, the first portion 142 may be pivotally connected to the bottom surface of the keycap 130 while each of the second portions 144 may slidably engage a chute 112*a* of the corresponding hook 112.

Additionally, the key switch 100 may further include a recovery unit 150 disposed above the top surface 120*a* of the circuit layer 120. The recovery unit 150 may be made elastic materials, such as silicone or rubber. In other embodiments, the key switch 100 may also include, but is not limited to, an X-shaped structure. Therefore, when keycap 130 of the key switch 100 moves down to a lower position upon reception of an external force, the first portion 142 of the support rod 140 pivots at the bottom surface of the keycap 130, and the second portion 144 of the support rod 140 engaging the baseplate 110 slides downward. Alternatively, when the external force is removed, the recovery unit 150 elastically recovers, causing the keycap 130 to move upward, the first portion 142 of the support rod 140 to reversely pivot at the bottom surface of the keycap 130, the second portion 144 of the support rod 140 engaging the baseplate 110 to slide upward, and thus returning the keycap 130 to the default position.

The circuit layer 120 includes a first sublayer 122 and a second sublayer 124. The first sublayer 122 is disposed above the baseplate 110 and has a second through hole 122*a*. The second sublayer 124 is disposed above the first sublayer 122 and has a third through hole 124*a*. When superimposing the first sublayer 122 and the second sublayer 124, a portion of the second sublayer 124 extends over the second through hole. The circuit layer 120 may be, but is not limited to, a thin film circuit board; more specifically, the circuit layer 120 may electrically conduct a signal when keycap 130 is being pressed. Additionally, the circuit layer 120 may further include, but is not limited to, a third sublayer 126 disposed between the first sublayer 122 and the second sublayer 124. The third sublayer 126 may be, but is not limited to, a plastic insulating sheet.

Figure 3:
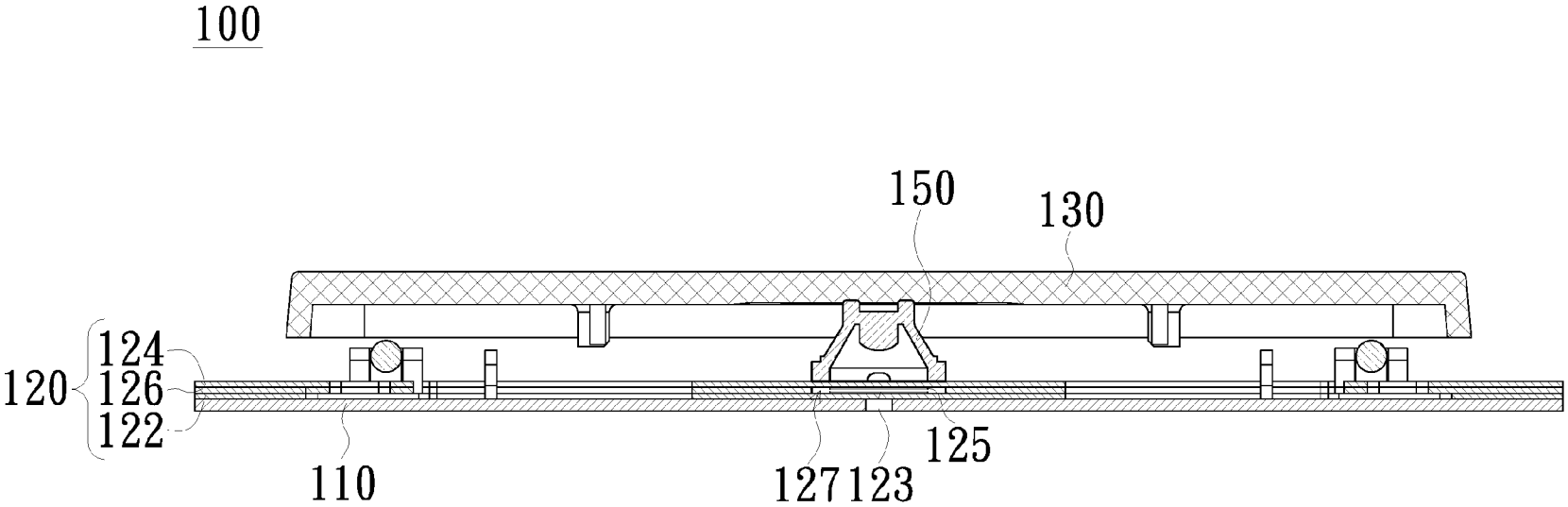
FIG. 3 is a schematic cross-sectional view of the key switch of FIG. 1 along line 3-3'.

Referring now to FIG. 3, which illustrates a cross-sectional view of the key switch of FIG. 1 along line 3-3'. Together with FIGS. 1 and 2, FIG. 3 shows that the third sublayer 126 includes an accommodating through hole 127 corresponding to the recovery unit 150 to electrically separate the first sublayer 122 and the second sublayer 124. When keycap 130 is being pressed, the recovery unit 150 received a downward force, causing the second sublayer 124 to deform, pass through the accommodating through hole 127, and be in direct contact with the first sublayer 122 and therefore electrically connect to the first sublayer 122. More specifically, the second sublayer 124 may include an upper electrode 125 disposed below the recovery unit 150, and the first sublayer 122 may include a lower electrode 123 disposed in correspondence to the upper electrode 125; that is, the upper electrode 125 and the lower electrode 123 may be disposed at two opposite sides of the accommodating through hole 127, so that the contact between the upper electrode 125 and the lower electrode 123 would activate the circuit layer to produce an electrical signal; the present invention is not limited thereto however. Alternatively, when the external force applied to the keycap 130 is removed, the first sublayer 122 and the second sublayer 124 would return to the default positions, resulting in disassociation of the upper electrode 125 with the lower electrode 123.

Figure 4:
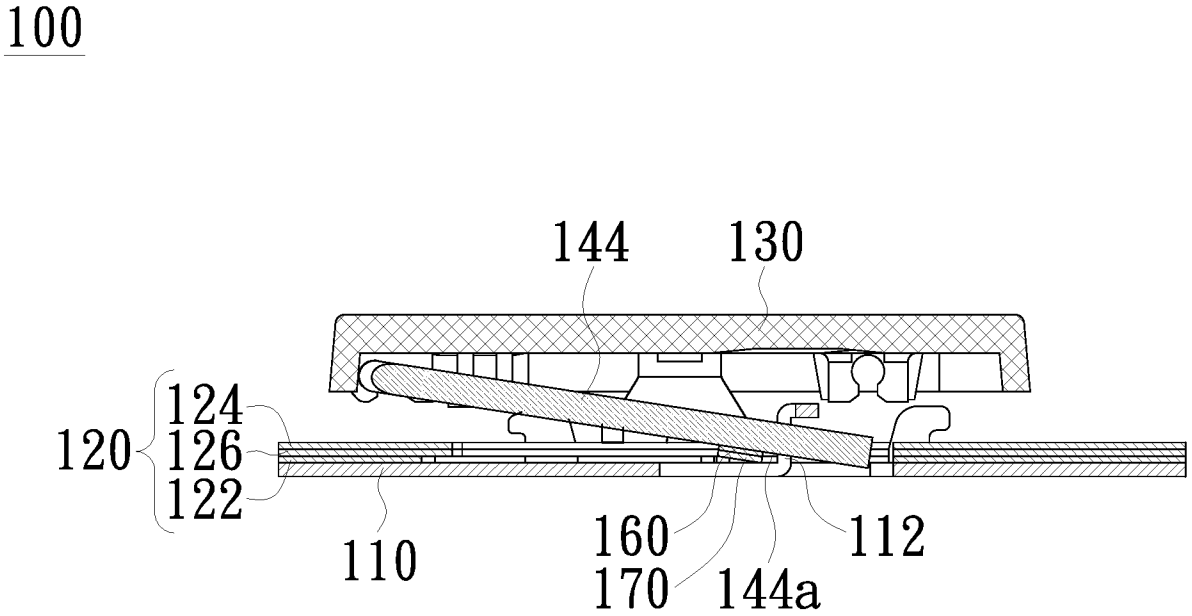
FIG. 4 is a schematic cross-sectional view of the key switch of FIG. 1 along line 4-4'.

Referring now to FIG. 4, which illustrates a cross-sectional view of the key switch of FIG. 1 along line 4-4'. Together with FIGS. 1 and 2, FIG. 4 shows that when superimposing the first sublayer 122 and the second sublayer 124, a portion of the second sublayer 124 extends over the second through hole 122*a* and forms a first resilient portion 160. The first resilient portion 160 includes at least four sides 161, with at least two of the four sides connecting to the second sublayer 124, and is neighboring to the hook 112 protruding over the second through hole 122*a*. Therefore, when the second portion 144 of the support rod 140 engages the hook 112, a lower end of the second portion 144 locates within the through hole formed by the first through hole 114, the second through hole 122*a*, and the third through hole 124*a*; and the first resilient portion 160 extends beneath and abuts against the second portion 144, so that the first resilient portion 160 buffers the collision between the second portion 144 of the support rod 140 and the baseplate 110 when the keycap 130 moves upward and downward in respect to the baseplate 110, thus reducing noises produced during pressing of the key switch 100 of the present embodiment.

Additionally, when the circuit layer 120 further includes the third sublayer 126 that is superimposable with the first sublayer 122 and the second sublayer 124, a portion of the third sublayer 126 extends over the second through hole 122*a* and forms a second resilient portion 170. The first resilient portion 160 and the second resilient portion 170 are at least partially overlapped. Consequently, the second resilient portion 170 may deform with the first resilient portion 160 in response to press forces applied onto the keycap 130, therefore providing sufficient buffer between the second portion 144 of the support rod 140 and the baseplate 110 and reducing noises produced during pressing of the key switch 100. Moreover, the second resilient portion 170 has a configuration substantially identical to that of the first resilient portion 160; that is, the second resilient portion 170 includes at least four sides 171, and at least two of the four sides 171 connect to the third sublayer 126. However, it is to be understood that the present invention is not limited thereto. In other embodiments, configuration of the third sublayer 126 may be substantially identical to that of the first sublayer 122; that is, space between the second portion 144 of the support rod 140 and the baseplate 110 may be buffered only by the first resilient portion 160 at the second sublayer 124 to accomplish typing noise reduction.

Figure 5A:
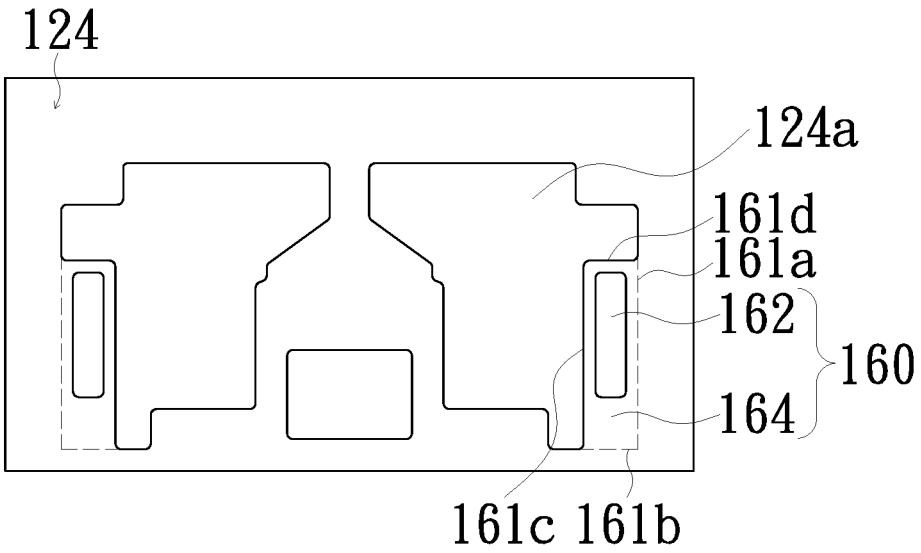
FIG. 5A is a schematic illustration of a second sublayer of the key switch of FIG. 1 according to an embodiment of the present invention.

Referring now to FIG. 5A, which specifically illustrates the second sublayer 124 of the key switch 100 of FIG. 1 according to an embodiment of the present invention. As shown in FIG. 5A, the first resilient portion 160 at the second sublayer 124 may include a fourth through hole 162 and a rectangular structure 164. The rectangular structure 164 extends between the third through hole 124*a* and the fourth through hole 162; that is, the first resilient portion 160 may be quadrilateral and have a first side 161*a*, a second side 161*b*, a third side 161*c*, and a fourth side 161*d* that are sequentially arranged. Likewise, the four sides 161 illustrated in FIG. 2 may be further defined as the first side 161*a*, the second side 161*b*, the third side 161*c*, and the fourth side 161*d*. The first resilient portion 160 connects to the second sublayer 124 via the first side 161*a* and the neighboring second side 161*b*; meanwhile, the third side 161*c* is neighboring to the third through hole 124*a* and the fourth side 161*d* is neighboring to the fourth through hole 162.

Figure 5B:
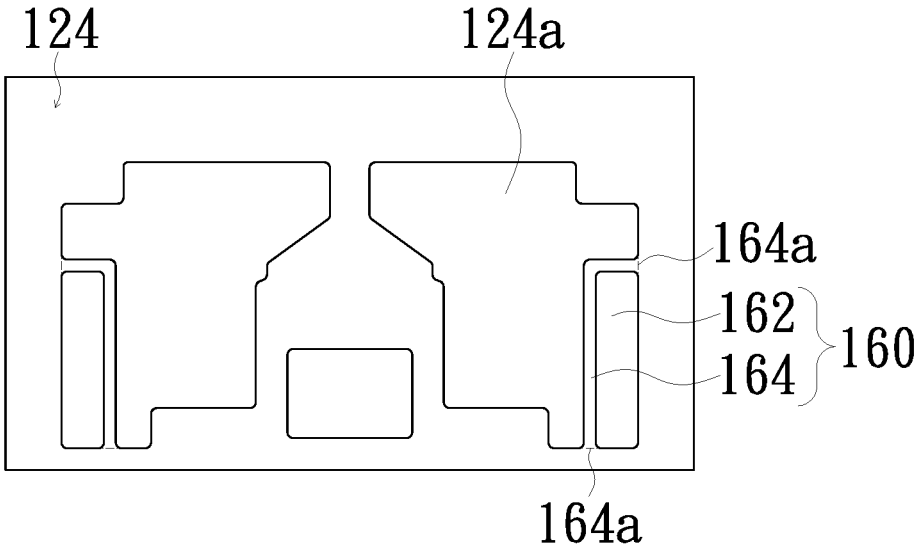
FIG. 5B is a schematic illustration of a second sublayer of the key switch of FIG. 1 according to an embodiment of the present invention.

Referring now to FIG. 5B, which illustrates the second sublayer 124 of the key switch 100 of FIG. 1 according to another embodiment of the present invention. As shown in FIG. 5B, the rectangular structure 164 the extends between the third through hole 124*a* and the fourth through hole 162; the rectangular structure 164 has two ends 164*a* connecting to the second sublayer 124. More specifically, the rectangular structure 164 of the present embodiment may be an L-shaped structure, with the two ends 164*a* of the L shape extending toward the first side 161*a* and the second side 161*b* of the first resilient portion 160, respectively.

Referring again to FIG. 4, as the rectangular structure 164 of the first resilient portion 160 extends beneath and abuts against the second portion 144 of the support rod 140 when the keycap 130 moves upward and downward in respect to the baseplate 110, strain required to deform the rectangular structure 164 may be adjustable by simply altering the size, shape, and position of the fourth through hole 162. In other words, size, shape, and position of the fourth through hole 162 may be adjusted according to the strength of press force applied onto the keycap 130, so that the rectangular structure 164 would deform under a corresponding press force. Consequently, not only the strength of press force required for a user to activate signal conduction at the circuit layer 120 would not be affected, collision between the second portion 144 of the support rod 140 and the baseplate 110 would be buffered, thus reducing the volume of noise produced during pressing the key switch 100.

Figure 6:
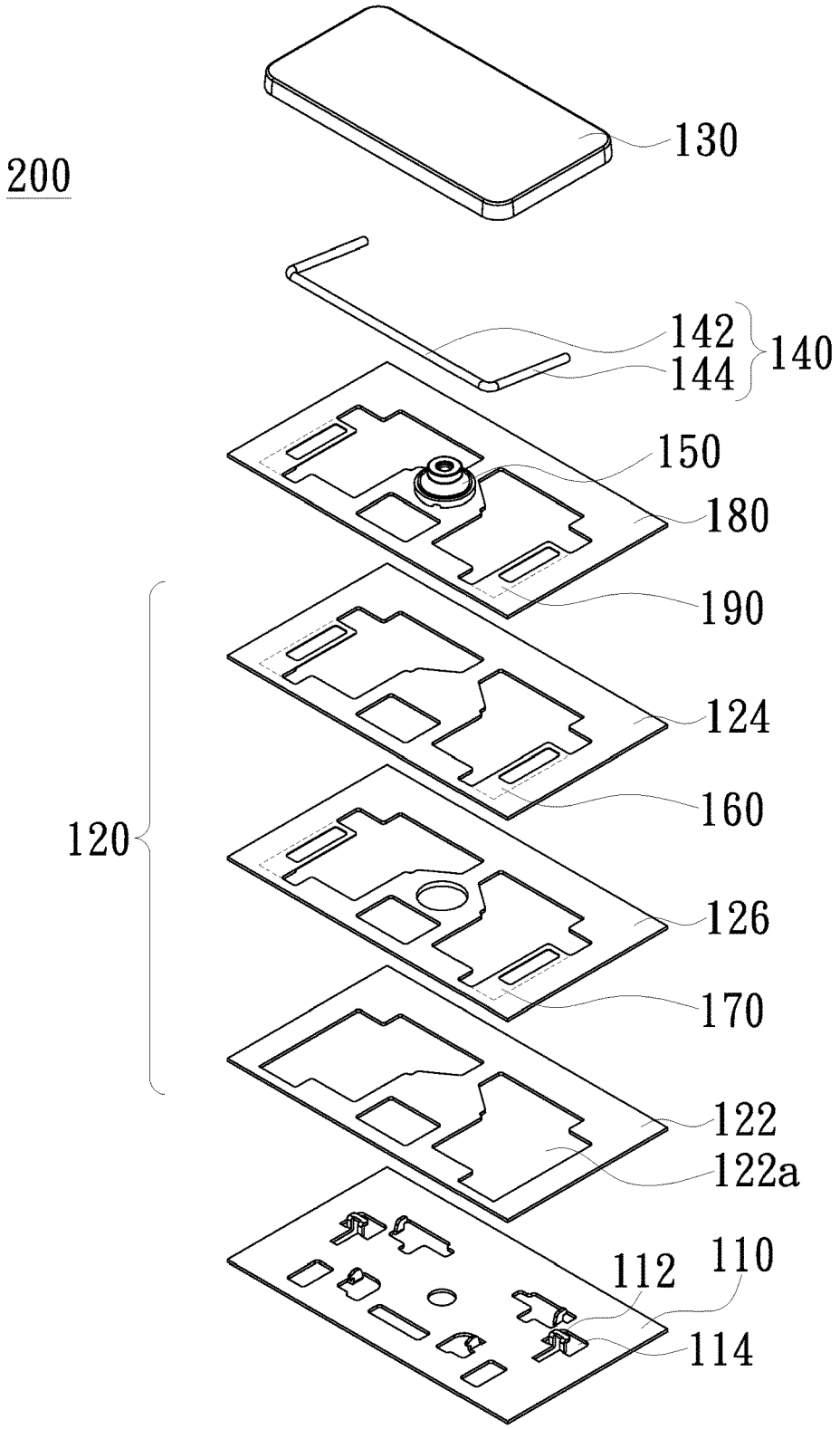
FIG. 6 is a schematic exploded view of a key switch according to another embodiment of the present invention.

Referring now to FIG. 6, which illustrates an exploded view of a key switch according to another embodiment of the present invention. It is to be understood that key switch 200 of the present embodiment is substantially identical to key switch 100 illustrated in FIG. 2. The main difference is that the key switch 200 further includes a film 180. The film 180 is disposed above the circuit layer 120 and the recovery unit 150 may be disposed above the film 180. When superimposing the film 180 and the circuit layer 120, a portion of the film 180 extends over the second through hole 122*a* and forms a third resilient portion 190. The first resilient portion 160 and the third resilient portion 190 are at least partially overlapped; for example, configuration of the third resilient portion 190 may be substantially identical to that of the first resilient portion 160, and thus the film 180 may have a configuration substantially identical to that of the second sublayer 124; the present invention is not limited thereto however. The film 180 may be, but is not limited to, made of elastic materials such as polyester (Mylar) or rubber. Therefore, the third resilient portion 190 on the film 180 may deform with the first resilient portion 160 in response to press forces applied onto the keycap 130, therefore providing sufficient buffer between the second portion 144 of the support rod 140 and the baseplate 110 and reducing noises produced during pressing of the key switch 200.

Likewise, when circuit layer 120 of the present embodiment includes the third sublayer 126 with the second resilient portion 190 disposed thereon, the first resilient portion 160, the second resilient portion 170, and the third resilient portion 190 may deform simultaneously in response to press forces applied onto the keycap 130, therefore providing sufficient buffer between the second portion 144 of the support rod 140 and the baseplate 110 and reducing noises produced during pressing of the key switch 200. However, the present invention is not limited thereto; in other embodiments, the third sublayer 126 may have a configuration substantially identically to that of the first sublayer 122, thus having no second resilient portion disposed thereon.

Figure 7:
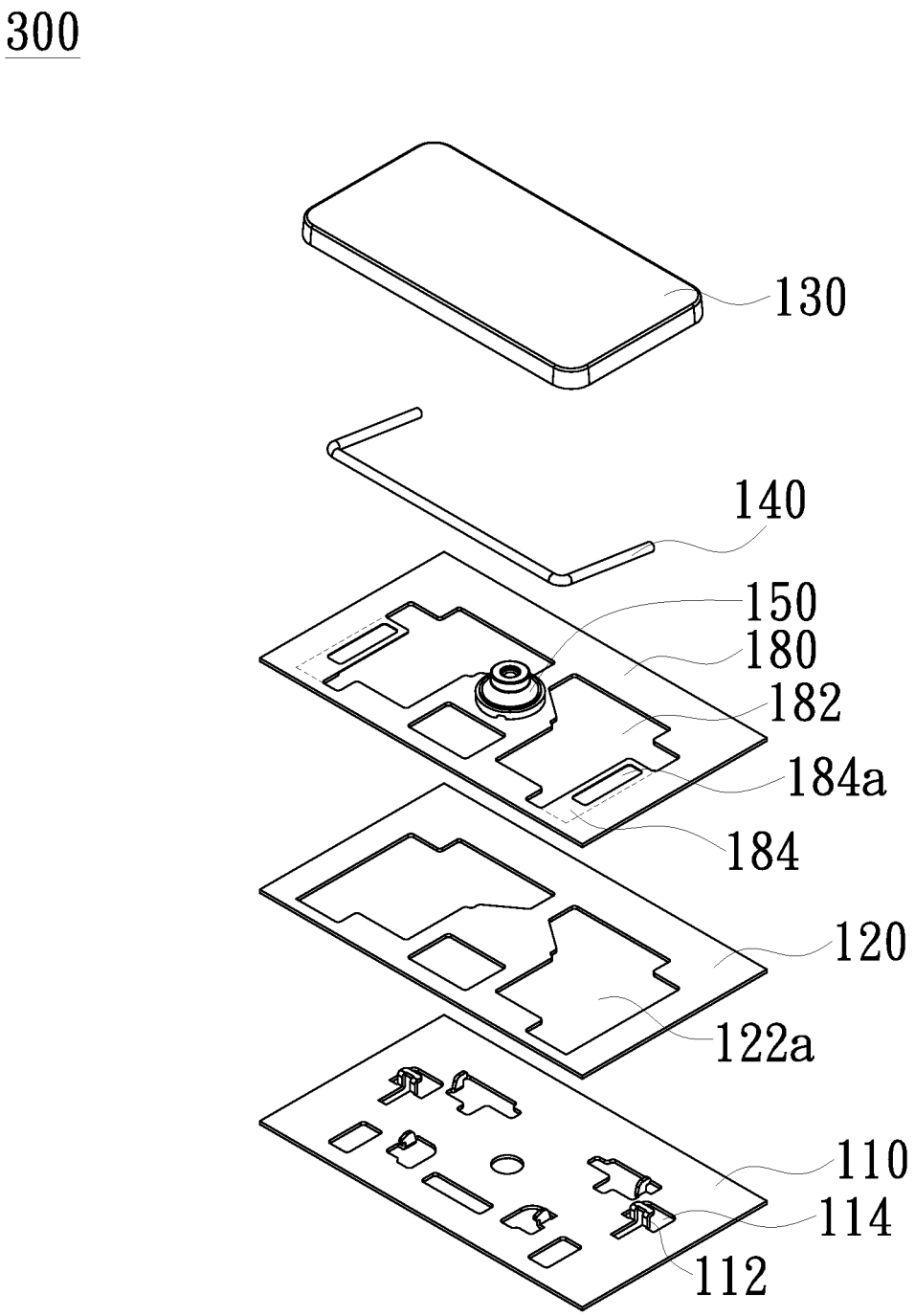
FIG. 7 is a schematic exploded view of a key switch according to yet another embodiment of the present invention.

Referring now to FIG. 7, which illustrates an exploded view of a key switch according to yet another embodiment of the present invention. It is to be understood that key switch 300 of the present embodiment is substantially identical to key switch 100 illustrated in FIG. 2. The main difference is that the key switch 300 further includes a film 180. The film 180 includes a third through hole 182, and a portion of the film 180 extends over the second through hole 122*a* to form a first resilient portion 184 on the film 180. In other words, the first resilient portion 184 adopted to reduce the volume of noises produced during pressing the key switch 300 may be disposed above the film 180. Therefore, the first resilient portion 184 on the film 180 buffers the collision between the second portion 144 of the support rod 140 and the baseplate 110, so as to reduce noises produced during pressing the key switch 300. Additionally, configuration of the first resilient portion 184 on the film 180 of the present embodiment may be substantially identical to that of the first resilient portion 160 at the second sublayer 124 as illustrated in FIG. 5A or in FIG. 5B; the present invention is not limited thereto however. Furthermore, the first resilient portion 184 on the film 180 may further include a fourth through hole 184*a*, for reducing the strain required to deform the first resilient portion 184. That is, size, shape, and position of the fourth through hole 184*a* may be adjusted according to the strength of press force applied onto the keycap 130, so that the first resilient portion 184 would deform under a corresponding press force. Consequently, not only the strength of press force required for a user to activate signal conduction at the circuit layer 120 would not be affected, collision between the second portion 144 of the support rod 140 and the baseplate 110 would be buffered, thus reducing the volume of noise produced during pressing the key switch 300.

Figure 8:
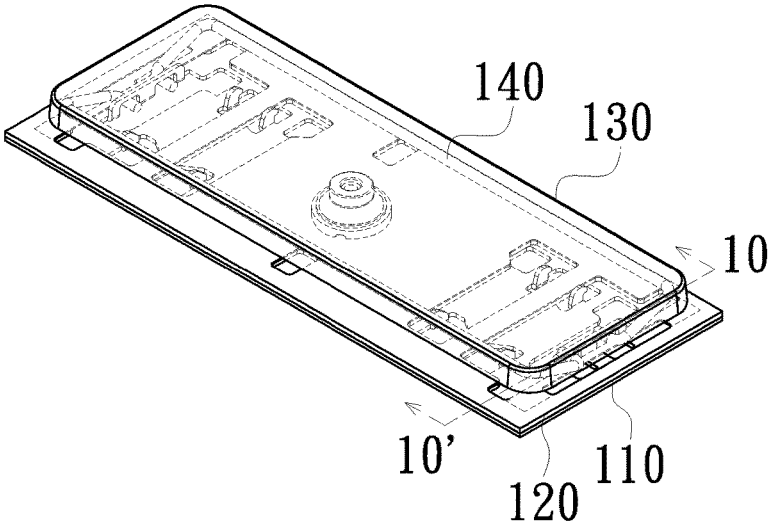
FIG. 8 is a schematic three-dimensional view of a key switch according to still another embodiment of the present invention.
Figure 9:
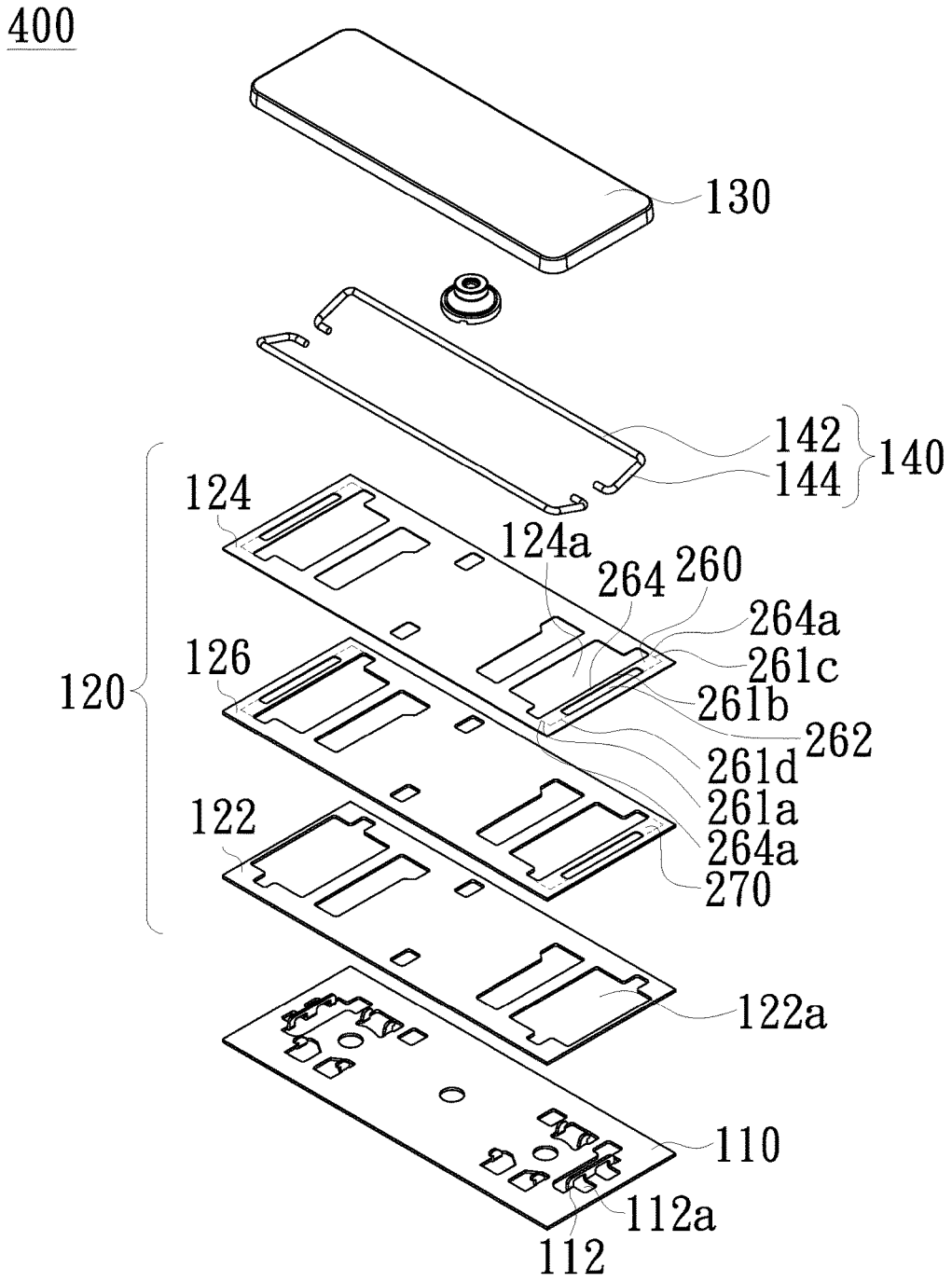
FIG. 9 is a schematic exploded view of the key switch of FIG. 8.

Referring now to FIG. 8 and FIG. 9, which illustrate a three-dimensional view and an exploded view of a key switch according to yet still another embodiment of the present invention. Key switch 400 of the present embodiment is substantially identical to key switch 100 as illustrated in FIGS. 1 and 2. The main difference is that the key switch 400 includes two support rods 140 and that each of the two opposing hooks 112 disposed at two opposite sides of the baseplate 110 has two chutes 112*a*. The lower end of the second portion 144 of the support rod 140 bends and engages the chute 112*a* of the hook 112, and each of the hooks 112 may simultaneously engage the lower ends of two second portions 144 on the same side; the present invention is not limited thereto however. Additionally, configuration of the first resilient portion 260 at the second sublayer 124 of the circuit layer 120 is different from that of the first resilient portion 160 in FIG. 2. More specifically, the first resilient portion 260 of the present embodiment is a quadrilateral sheet having a first side 261*a*, a second side 261*b*, a third side 261*c*, and a fourth side 261*d* that are sequentially arranged. The first resilient portion 260 connects to the second sublayer 124 via the first side 261*a* and the third side 261*c* opposite to the first side 261*a*, and the second side 261*b* is neighboring to the third through hole 124*a*. Further, the first resilient portion 260 may include a fourth through hole 262 and a linear structure 264. The linear structure 264 has two ends 264*a* and extends between the third through hole 124*a* and the fourth through hole 262 at the second sublayer 124. Meanwhile, the two ends 264*a* of the linear structure 264 extend toward the first side 261*a* and the third side 261*c*, respectively; that is, the first resilient portion 260 is a U-shaped sheet in the present embodiment. The present invention is not limited thereto however.

Figure 10:
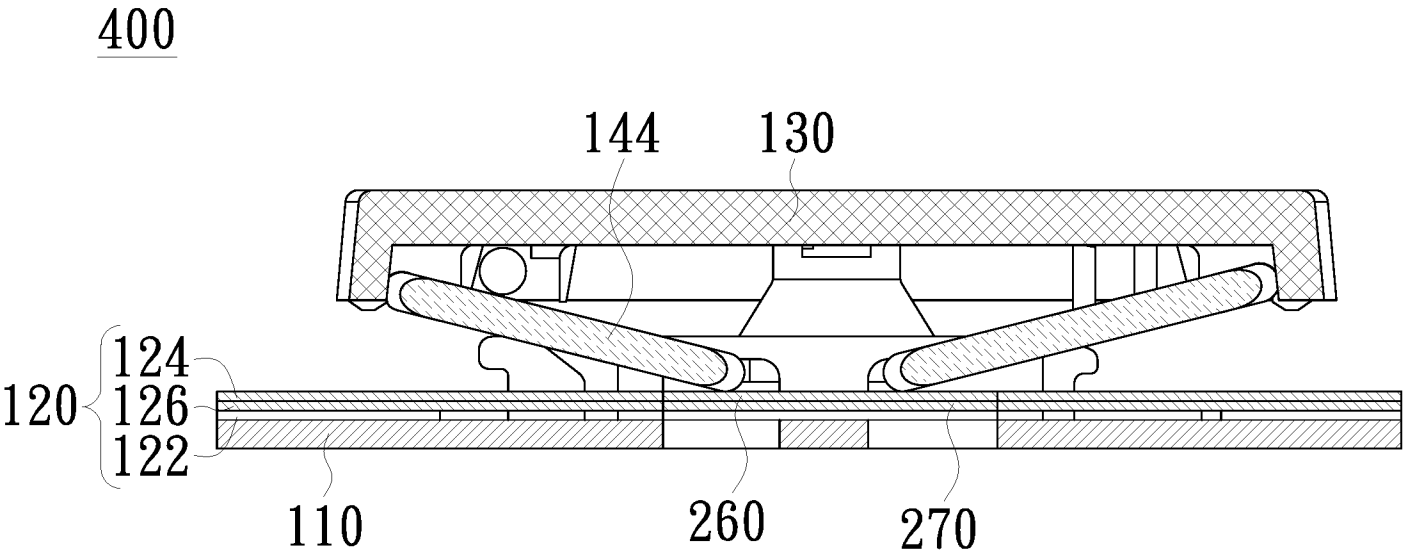
FIG. 10 is a schematic cross-sectional view of the key switch of FIG. 8 along line 10-10'.

Referring now to FIG. 10, which illustrates a cross-sectional view of the key switch of FIG. 8 along line 10-10'. As shown in FIGS. 8 through 10, if the lower end of the second portion 144 of the support rod 140 extends horizontally, the lower end of the second portion 144 engages the hooks by extending on top of the through hole formed together by the first through hole 114, the second through hole 122*a*, and the third through hole 124*a*. Alternatively, if the lower end of the second portion 144 bends, the lower end of the second portion 144 passes through the through hole formed together by the first through hole 114, the second through hole 122*a*, and the third through hole 124*a*; and the linear structure 264 of the first resilient portion 260 extends beneath and abuts against the second portion 144 toward the first side 261*a* and the third side 261*c*. Consequently, the first resilient portion 260 would buffer the collision between the second portion 144 of the support rod 140 and the baseplate 110 when the keycap 130 moves upward and downward in respect to the baseplate, therefore reducing the noises produced by pressing the key switch 400.

Referring again to FIG. 9. It is apparent that the circuit layer 120 of the present embodiment may further include a third sublayer 126 disposed between the first sublayer 122 and the second sublayer 124. A portion of the third sublayer 126 extends over the second through hole 122*a* and forms a second resilient portion 270. Configuration of the second resilient portion 270 is substantially identical to that of the first resilient portion 260; the present invention is not limited thereto however. In other embodiments, the third sublayer 126 may not include a second resilient portion; that is, the third sublayer 126 has a configuration substantially identical to that of the first sublayer 122. Furthermore, teachings of the embodiment illustrated in FIG. 6 have made it apparent that the key switch may further include a film having a third resilient portion and disposed above the circuit layer. Configuration of the third resilient portion may be, but is not limited to, substantially identical to that of the first resilient portion. In other embodiments, the film may be configured to substantially resemble the first sublayer 122; that is, the film may have no third resilient portion disposed thereon.

Figure 11:
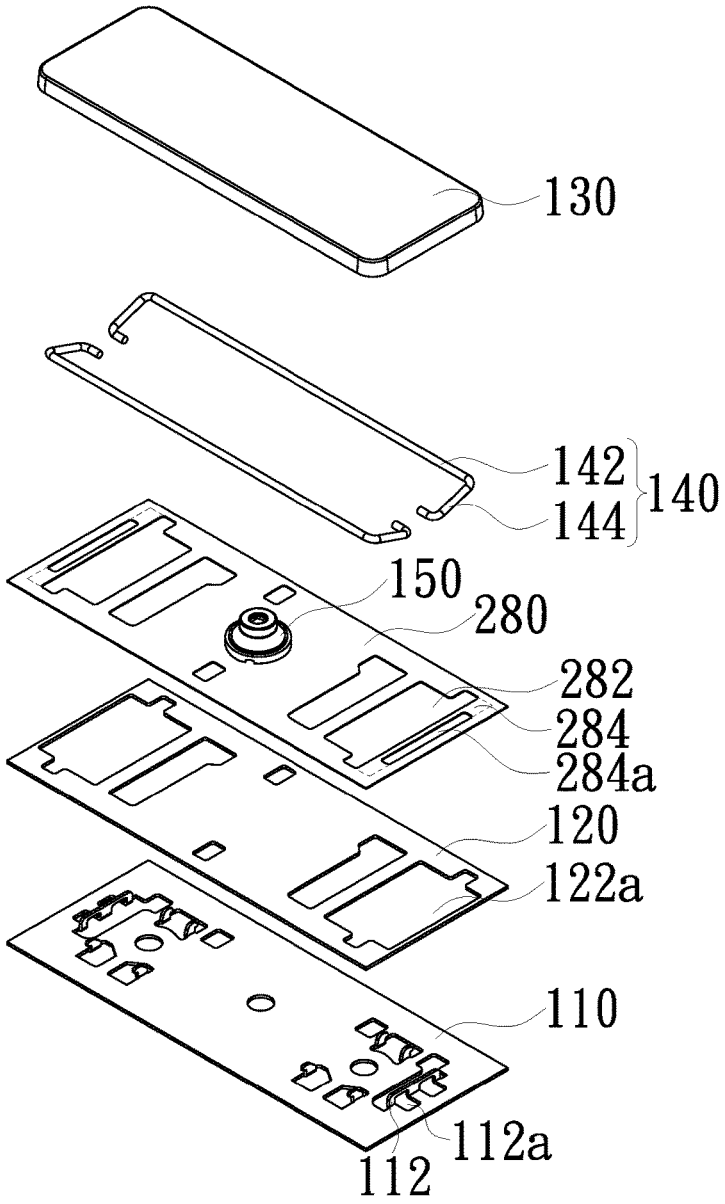
FIG. 11 is a schematic exploded view of a key switch according to yet still another embodiment of the present invention.

Referring now to FIG. 11, which illustrates an exploded view of a key switch according to yet still another embodiment of the present invention. Key switch 500 as shown in FIG. 11 is substantially identical to the key switch 400 illustrated in FIG. 9. The main difference is that the key switch 500 of the present embodiment includes a film 280 having a third through hole 282. A portion of the film 280 extends over the second through hole 122*a* and forms a resilient portion 284. The film 280 buffers the collision between the second portion 144 of the support rod 140 and the baseplate 110, so as to reduce the noises produced during pressing of the key switch 500. Additionally, configuration of the first resilient portion 284 of the film 280 may be substantially identical to the first resilient portion 260 of the second sublayer 124 as illustrated in FIG. 9. Consequently, as the first resilient portion 284 extends beneath and abuts against the second portion 144 of the support rod 140 when the keycap 140 moves upward and downward in respect to the baseplate 110, the fourth through hole 284*a* reduces the strain required to deform the first resilient portion 284. That is, size, shape, and position of the fourth through hole 284*a* may be adjusted according to the strength of press force applied onto the keycap 130, so that the first resilient portion 284 would deform under a corresponding press force. In this way, not only the strength of press force required for a user to activate signal conduction at the circuit layer 120 would not be affected, collision between the second portion 144 of the support rod 140 and the baseplate 110 would be buffered, thus reducing the volume of noise produced during pressing the key switch 500.

Figure 12:
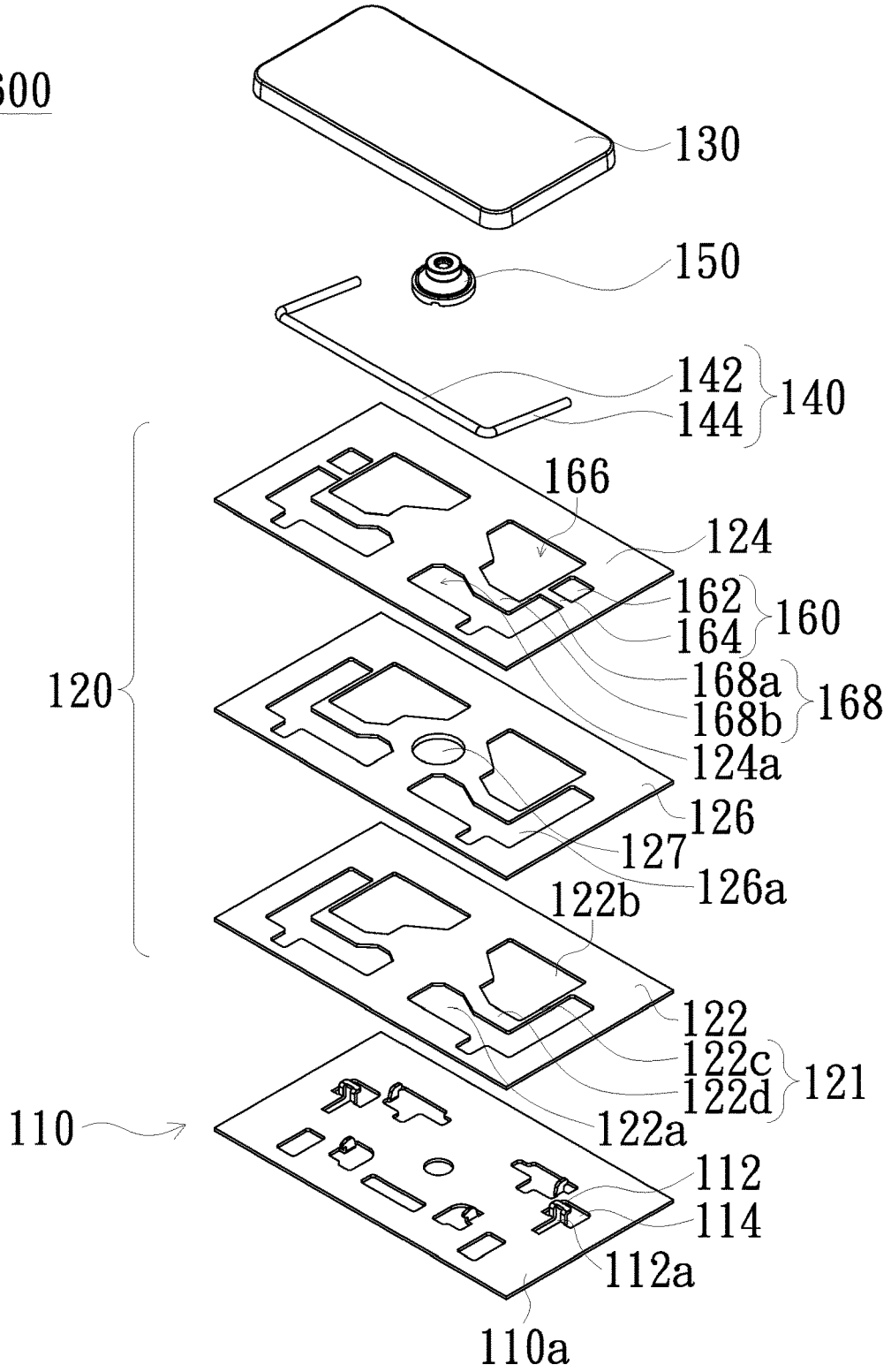
FIG. 12 is a schematic exploded view of a key switch according to yet still another embodiment of the present invention.
Figure 13:
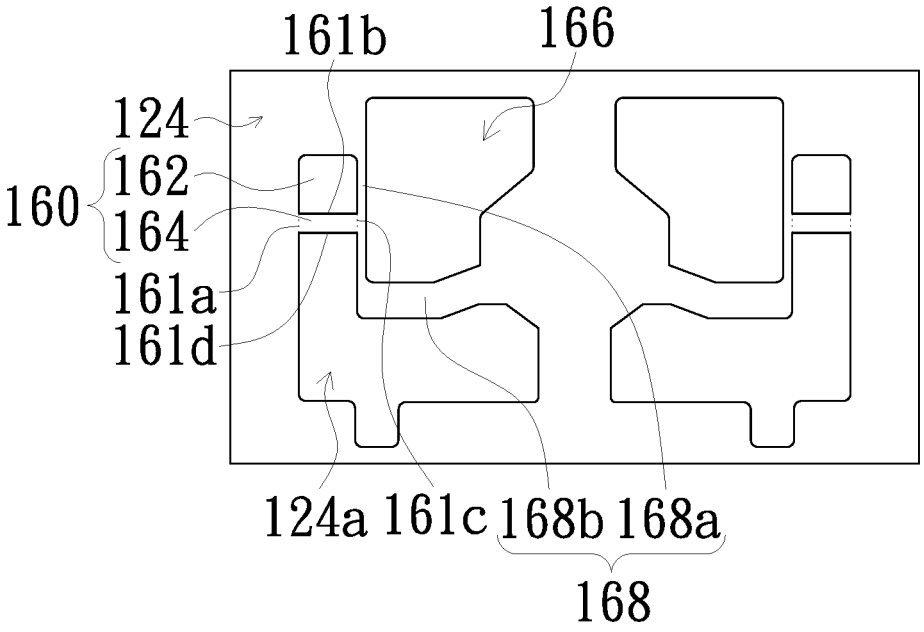
FIG. 13 is a schematic illustration of a second sublayer of the key switch of FIG. 12 according to an embodiment of the present invention.

Referring now to FIG. 12 and FIG. 13, which illustrate an exploded view of a key switch and a plain view of the second sublayer of the key switch according to yet still another embodiment of the present invention. Key switch 600 as shown in FIGS. 12 and 13 is substantially identical to the key switch 100 illustrated in FIGS. 1 and 2. The main difference lies on the configuration of the circuit layer 120.

In the present embodiment, the second sublayer 124 of the circuit layer 120 of the key switch 600 is an upper electrode layer, and the lower surface of the second sublayer 124 typically is disposed with an upper electrode switch. The second sublayer 124 includes a third through hole 124*a*, a fourth through hole 162, a fifth through hole 166, a rectangular structure 164, and a second bridging extension 168. The rectangular structure 164 includes a first side 161*a*, a second side 161*b*, a third side 161*c*, and a fourth side 161*d* that are sequentially arranged; the first side 161*a* is opposite and not neighboring to the third side 161*c*; the second side 161*b* is neighboring to the fourth through hole 162, and the fourth side 161*d* is neighboring to the third through hole 124*a*. The second bridging extension 168 is further divided into a first extension 168*a* extending along the y-axis and a second extension 168*b* extending along the x-axis. The first extension 168*a* separates at least the fifth through hole 166 and the fourth through hole 162; the second extension 168*b* separates at least the fifth through hole 166 and the third through hole 124*a*; and the first extension 168*a* connects to the second extension 168*b*. The rectangular structure 164 connects to the edge of the keycap 130 neighboring to the second sublayer 124 via the first side 161*a*, and to the first extension 168*a* via the third side 161*c*, so that the rectangular structure 164 separates the third through hole 124*a* and the fourth through hole 162 and two ends (that is, the first side 161*a* and the third side 161*c*) of the rectangular structure 164 are structurally supported, therefore providing stronger elasticity for noise reduction. In the present embodiment, while the second bridging extension 168 is typically of an L contour, the exact shape of the second bridging extension 168 is not limited thereto; all possible shapes of the second bridging extension 168 that (a) have disconnection between the second side 161*b* and the fourth side 161*d*, with the second side 161*b* and the fourth side 161*d* connecting to any of the through holes; and (b) connects to the third side 161*c* of the rectangular structure 164 are feasible for the present invention.

On the other hand, the first sublayer 122 of the circuit layer 120 of the present embodiment is a lower electrode layer, typically disposed in correspond to the upper electrode switch. The upper surface of the first sublayer 122 is disposed with a lower electrode switch for selectively activate electrical conduction. The first sublayer 122 includes a second through hole 122*a* and a sixth through hole 122*b*, and a first bridging extension 121; the first bridging extension 121 is further divided into a third extension 122*c* and a fourth extension 122*d*. When superimposing the first sublayer 122 with the second sublayer 124, elements extending over the second through hole 122*a* include the rectangular structure 164, at least partial of the third through hole 124*a*, and at least partial of the fourth through hole 162, such that the rectangular structure 164 extends over the second through hole 122*a*; further, the third extension 122*c* and the fourth extension 122*d* superimpose with and is disposed under the first extension 168*a* and the second extension 168*b*, such as the first bridging extension 121 structurally supports the second bridging extension 168; the present invention is not limited thereto however. The third extension 122*c* and the fourth extension 122*d* separates the sixth through hole 122*b* from the second through hole 122*a*; when superimposing the first sublayer 122 with the second sublayer 124, the sixth through hole 122*b* superimposes with the fifth through hole 166; the present invention is not limited thereto however.

In the present embodiment, the third sublayer 126 further included in the circuit layer 120 is a spacer layer, typically disposed in correspond to the upper and lower electrode switches. The third sublayer 125 is disposed with an accommodating through hole 127 for allowing the upper electrode to deform and pass through the accommodating through hole 127 so as to contact the lower electrode switch for electrical conduction when the upper electrode switch is pressed by the user. The third sublayer 126 superimposes with the first sublayer 122 and the second sublayer 124; as shown in FIG. 12, configuration of the third sublayer 126 may be identical to that of the second sublayer 124 except for the accommodating through hole 127 at the third sublayer 126. In other words, the third sublayer 126 may also include a rectangular structure; together with the rectangular structure 164 at the second sublayer 124, the two rectangular structures support the support rod 140 for noise reduction; the present invention is not limited thereto however. In other embodiments, configuration of the third sublayer 126 may be identical to that of the first sublayer 122 except for the accommodating through hole 127 at the third sublayer 126. In other words, the third sublayer 126 may also be disposed without a rectangular structure; the through hole 126*a* at the third sublayer 125 superimposes with and covers the rectangular structure 164, at least partial of the third through hole 124*a*, and at least partial of the fourth through hole 162; such that the entire circuit layer 120 uses only the rectangular structure 164 at the second sublayer 124 to support the support rod 140 for noise reduction.

Figure 14:
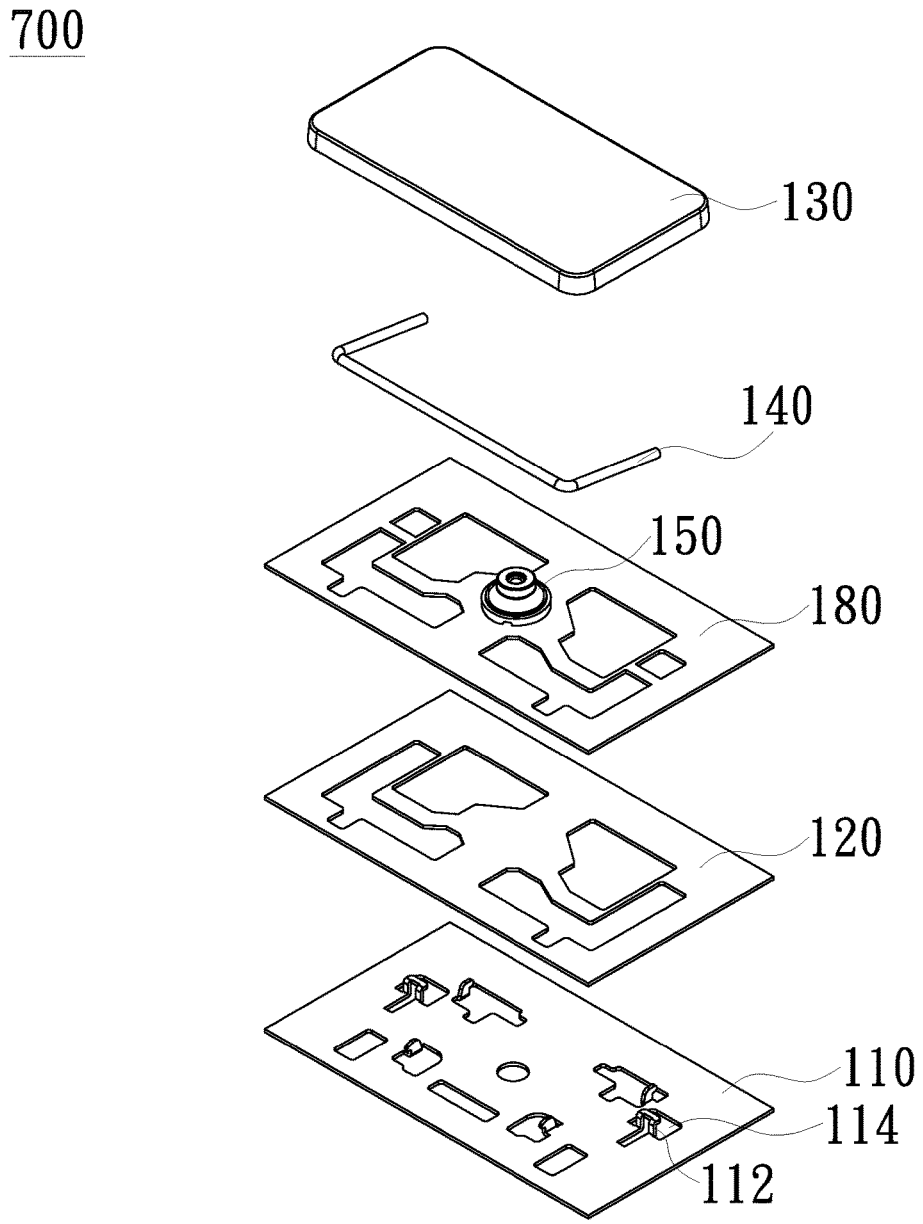
FIG. 14 is a schematic exploded view of a key switch according to yet still another embodiment of the present invention.
Figure 15:
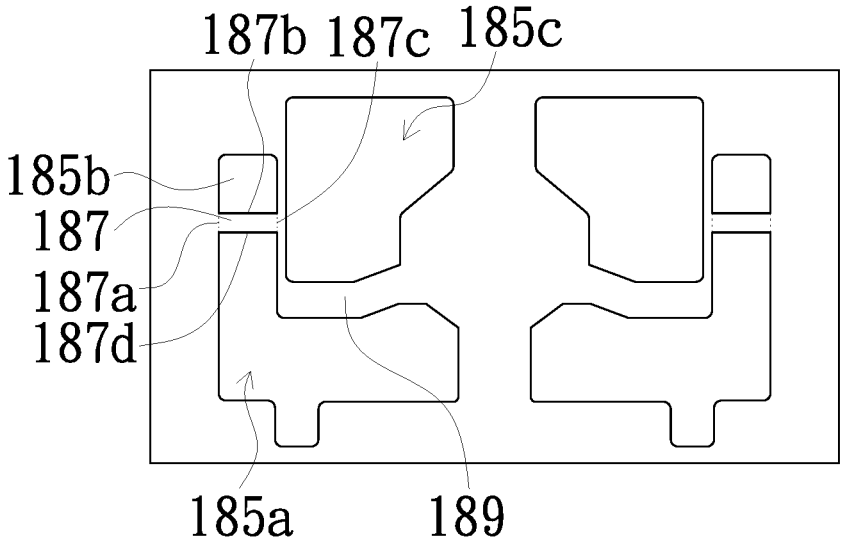
FIG. 15 is a schematic illustration of a film of the key switch of FIG. 14 according to an embodiment of the present invention.

Referring now to FIG. 14 and FIG. 15, which illustrate an exploded view of a key switch and a plain view of the film of the key switch according to yet still another embodiment of the present invention. It is to be understood that key switch 700 of the present embodiment as shown in FIGS. 14 and 15 is substantially identical to the key switch 300 illustrated in FIG. 7; that is, a film 180 is disposed above the circuit layer 120, and the recovery unit 150 is disposed above the film 180 but not the circuit layer 120; however, the film 180 in FIG. 14 has a configuration different from that of film in FIG. 7. Instead, configuration of the film 180 in FIG. 14 is identical to that of the second sublayer 124 of the key switch 600 shown in FIG. 12; that is, the film 180 includes a seventh through hole 185*a*, an eighth through hole 185*b*, a ninth through hole 185*c*, a rectangular structure 187, and a third bridging extension 189. The rectangular structure 187 has at least a first side 187*a*, a second side 187*b*, a third side 187*c*, and a fourth side 187*d* that are sequentially arranged. The first side 187*a* is opposite to and disconnect with the third side 187*b*; the second side 187*b* is neighboring to the eighth through hole 185*b*, and the fourth side 187*d* is neighboring to the seventh through hole 185*a*. The rectangular structure 187 connects to the edge of the keycap 130 neighboring to the film 180 via the first side 187*a*, and to the third bridging extension 189 via the third side 187*c*, so that the rectangular structure 187 separates the eighth through hole 185*b* and the seventh through hole 185*a* and two ends (that is, the first side 187*a* and the third side 187*c*) of the rectangular structure 187 are structurally supported; therefore, configuration of the film 180 of the present embodiment may be identical, but not limited, to the second sublayer 124 illustrated in FIG. 13. On the other hand, configuration of the circuit layer 120 of the present embodiment may be identical to the circuit layer 120 of the key switch 600 illustrated in FIG. 12; that is, the circuit layer 120 may (a) include a rectangular structure 164 only at the second sublayer 124, but not at any other sublayers; or (b) include two rectangular structures, with one disposed at the second sublayer 124 and the other at the third sublayer 126, and only the first sublayer 122 is disposed without a rectangular structure; the present invention is not limited thereto however.

According to the aforementioned embodiments of the present invention, the key switch of the present invention provides the following advantages. The key switch utilized a resilient portion to support the second portion of the support rod so as to buffer the collision between the second portion and the baseplate when the keycap moves upward and downward in respect to the baseplate. Moreover, the first resilient portion may be disposed with one or more through holes for reducing the strain required to deform the first resilient portion, such that the first resilient portion would deform under a corresponding press force. Consequently, a user of the key switch may easily activate electrical conduction at the circuit layer by pressing the keycap with a proper press force, and noise produced during key pressing may be reduced as well.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key switch, comprising:

a baseplate, having a hook and a first through hole which is neighbor to the hook;

a circuit layer, comprising:

a first sublayer, disposed above the baseplate and being next to the baseplate, having a second through hole; and a second sublayer, disposed above the first sublayer and being next to the first sublayer, having a third through hole, a portion of the second sublayer extending to a region in a vertical direction of the second through hole and forming a first resilient portion that has a fourth through hole and at least four sides, wherein at least the two sides of the four sides connect to the second sublayer and the first resilient portion is neighbor to the hook;

a support rod, disposed above the second sublayer and having a first portion and two second portions, each of the second portions having a lower end shaft, the lower end shaft extending substantially horizontally, a long axis of each of the two lower end shafts being substantially perpendicular to a long axis of the first resilient portion; and a keycap, disposed above the circuit layer and being next to the second sublayer, the support rod being between the keycap and the second sublayer, the first portion movably connecting to the keycap so as to make the keycap move up and down with respect to the baseplate;

wherein a lower end of the second portion is urged toward different locations of the first resilient portion when the keycap moves up and down so as to make the lower end move along the long axis of the first resilient portion, and the first resilient portion extends beneath and abuts against the second portion in order to buffer a collision between the second portion and the baseplate.

2. The key switch according to claim 1, wherein the first resilient portion comprises a rectangular structure, which has two ends and extends between the third through hole and the fourth through hole, and the two ends of the rectangular structure connect to the second sublayer.

3. The key switch according to claim 1, wherein the first resilient portion is a quadrilateral sheet and has a first side, a second side, a third side, and a fourth side that are sequentially arranged, at least the first side and the third side connecting to the second sublayer, the first side being opposite to the third side, and at least the second side being neighbor to the third through hole.

4. The key switch according to claim 3, wherein the first resilient portion comprises a linear structure with two ends, the linear structure extending between the third through hole and the fourth through hole, and the two ends of the linear structure extending toward the first side and the third side respectively.

5. The key switch according to claim 4, wherein the first resilient portion is a U-shaped sheet.

6. A key switch, comprising:

a baseplate, having a hook and a first through hole which is neighbor to the hook;

a circuit layer, comprising:

a first sublayer, disposed above the baseplate and being next to the baseplate, having a second through hole; and a second sublayer, disposed above the first sublayer and being next to the first sublayer, having a third through hole, a portion of the second sublayer extending to a region in a vertical direction of the second through hole and forming a first resilient portion that has a fourth through hole and at least four sides, wherein at least the two sides of the four sides connect to the second sublayer and the first resilient portion is neighbor to the hook;

a support rod, disposed above the second sublayer and having a first portion and two second portions, each of the second portions having a lower end shaft, when the keycap moving up and down, the lower end shaft extending substantially above the third through hole, the second through hole and the first through hole; and a keycap, disposed above the circuit layer and being next to the second sublayer, the support rod being between the keycap and the second sublayer, the first portion movably connecting to the keycap so as to make the keycap move up and down with respect to the baseplate;

wherein the first resilient portion extends beneath and abuts against the second portion in order to buffer a collision between the second portion and the baseplate.

7. The key switch according to claim 6, wherein the first resilient portion comprises a rectangular structure, which has two ends and extends between the third through hole and the fourth through hole, and the two ends of the rectangular structure connect to the second sublayer.

8. The key switch according to claim 6, wherein the first resilient portion is a quadrilateral sheet and has a first side, a second side, a third side, and a fourth side that are sequentially arranged, at least the first side and the third side connecting to the second sublayer, the first side being opposite to the third side, and at least the second side being neighbor to the third through hole.

9. The key switch according to claim 8, wherein the first resilient portion comprises a linear structure with two ends, the linear structure extending between the third through hole and the fourth through hole, and the two ends of the linear structure extending toward the first side and the third side respectively.

10. The key switch according to claim 9, wherein the first resilient portion is a U-shaped sheet.

11. A key switch, comprising:

a baseplate, having a hook and a first through hole which is neighbor to the hook;

a circuit layer, disposed above the baseplate and being next to the baseplate, having a second through hole;

a film, disposed above the circuit layer and being next to the circuit layer, having a third through hole, a portion of the film extending to a region in a vertical direction of the second through hole and forming a first resilient portion that has a fourth through hole and at least four sides, wherein at least the two sides of the four sides connect to the film and the first resilient portion is neighbor to the hook;

a support rod, disposed above the film and having a first portion and two second portions, each of the second portions having a lower end shaft, the lower end shaft extending substantially horizontally, a long axis of each of the two lower end shafts being substantially perpendicular to a long axis of the first resilient portion; and a keycap, disposed above the film and being next to the film, the support rod being between the keycap and the film, the first portion movably connecting to the keycap so as to make the keycap move up and down with respect to the baseplate;

wherein a lower end of the second portion is urged toward different locations of the first resilient portion when the keycap moves up and down so as to make the lower end move along the long axis of the first resilient portion, and the first resilient portion extends beneath and abuts against the second portion in order to buffer a collision between the second portion and the baseplate.

12. The key switch according to claim 11, wherein the first resilient portion comprises a rectangular structure, which has two ends and extends between the third through hole and the fourth through hole, and the two ends of the rectangular structure connect to the film.

13. The key switch according to claim 11, wherein the first resilient portion is a quadrilateral sheet and has a first side, a second side, a third side, and a fourth side that are sequentially arranged, at least the first side and the third side connecting to the second sublayer, the first side being opposite to the third side, and at least the second side being neighbor to the third through hole.

14. The key switch according to claim 13, wherein the first resilient portion comprises a linear structure with two ends, the linear structure extending between the third through hole and the fourth through hole, and the two ends of the linear structure extending toward the first side and the third side respectively.

15. The key switch according to claim 14, wherein the first resilient portion is a U-shaped sheet.

16. A key switch, comprising:

a baseplate, having a hook and a first through hole which is neighbor to the hook;

a circuit layer, disposed above the baseplate and being next to the baseplate, having a second through hole;

a film, disposed above the circuit layer and being next to the circuit layer, having a third through hole, a portion of the film extending to a region in a vertical direction of the second through hole and forming a first resilient portion that has a fourth through hole and at least four sides, wherein at least the two sides of the four sides connect to the film and the first resilient portion is neighbor to the hook;

a support rod, disposed above the film and having a first portion and two second portions, each of the second portions having a lower end shaft, when the keycap moving up and down, the lower end shaft extending substantially above the third through hole, the second through hole and the first through hole; and a keycap, disposed above the film and being next to the film, the support rod being between the keycap and the film, the first portion movably connecting to the keycap so as to make the keycap move up and down with respect to the baseplate;

wherein the first resilient portion extends beneath and abuts against the second portion in order to buffer a collision between the second portion and the baseplate.

17. The key switch according to claim 16, wherein the first resilient portion comprises a rectangular structure, which has two ends and extends between the third through hole and the fourth through hole, and the two ends of the rectangular structure connect to the film.

18. The key switch according to claim 16, wherein the first resilient portion is a quadrilateral sheet and has a first side, a second side, a third side, and a fourth side that are sequentially arranged, at least the first side and the third side connecting to the second sublayer, the first side being opposite to the third side, and at least the second side being neighbor to the third through hole.

19. The key switch according to claim 18, wherein the first resilient portion comprises a linear structure with two ends, the linear structure extending between the third through hole and the fourth through hole, and the two ends of the linear structure extending toward the first side and the third side respectively.

20. The key switch according to claim 19, wherein the first resilient portion is a U-shaped sheet.

* * * * *